US005214814A

United States Patent [19]

Eremita et al.

[11] Patent Number: 5,214,814

[45] Date of Patent: Jun. 1, 1993

[54] MULTIPLE POSTURE SLEEPING PILLOW WITH ARM REST

[76] Inventors: Nunzio A. Eremita; Anna J. Eremita, both of 2 Radcliff Rd., Staten Island, N.Y. 10305

[21] Appl. No.: 845,640

[22] Filed: Mar. 4, 1992

[51] Int. Cl.[5] ..... A47C 20/02

[52] U.S. Cl. ..... 5/636; 5/646

[58] Field of Search ..... 5/622, 623, 632, 636, 5/637, 640, 646, 644

[56] References Cited

U.S. PATENT DOCUMENTS

| | | | |
|---|---|---|---|
| D. 204,443 | 4/1966 | Wood | 5/636 |
| D. 308,455 | 6/1990 | Jenney | 5/636 |
| 1,385,355 | 7/1921 | Banks | 5/636 |
| 2,700,779 | 1/1955 | Tolkowsky | 5/632 |
| 2,782,427 | 2/1957 | Ericson | 5/632 |
| 2,839,766 | 6/1958 | Hull | 5/632 |
| 3,883,906 | 5/1975 | Sumpter | 5/632 |
| 4,235,472 | 11/1980 | Sparks et al. | 5/646 |
| 4,730,801 | 3/1988 | Cloward | 5/632 |
| 5,018,231 | 5/1991 | Wang | 5/636 |

FOREIGN PATENT DOCUMENTS

| | | | |
|---|---|---|---|
| 452283 | 11/1927 | Fed. Rep. of Germany | 5/632 |

*Primary Examiner*—Michael F. Trettel
*Assistant Examiner*—Michael Milano
*Attorney, Agent, or Firm*—Richard L. Miller

[57] ABSTRACT

This multiple posture sleeping pillow is designed to be a therapeutic to be used by persons having whip lash, a herniated cervical disc and arthritic neck conditions. The article utilizes a pair of spaced apart cushions, having grooved furrow arm rest, that are secured to ends of a cylindrical or oval intermediate neck support member. This intermediate member is designed to support the neck of a prone person while keeping the head of the user somewhat elevated.

9 Claims, 2 Drawing Sheets

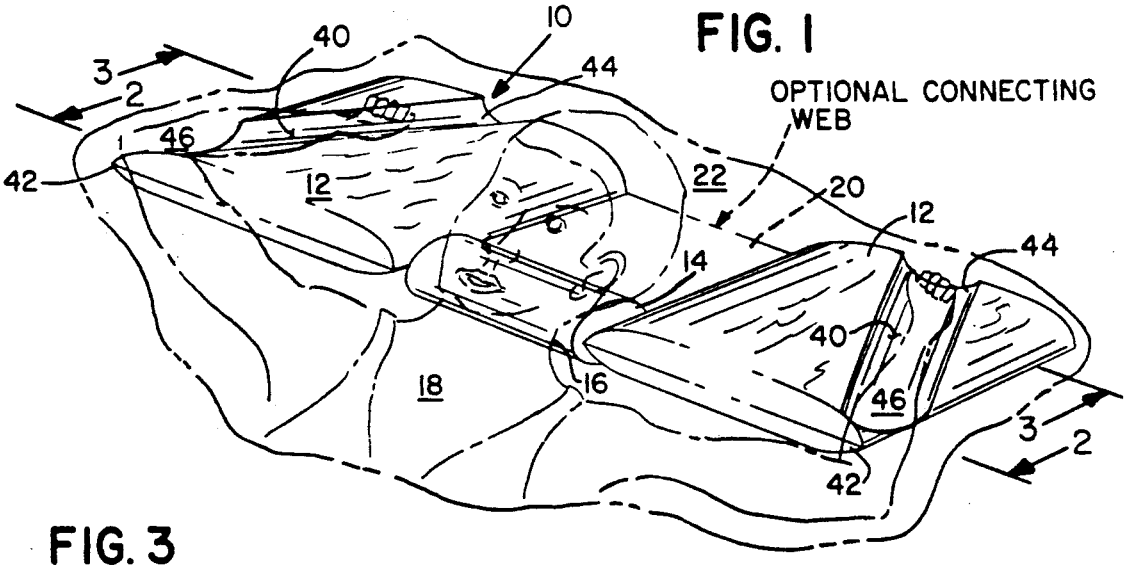
FIG. 1
FIG. 3
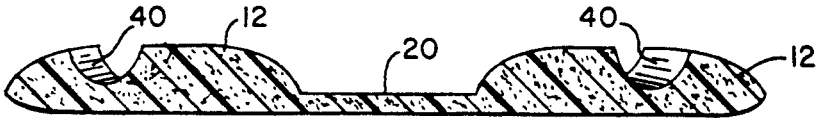
FIG. 2
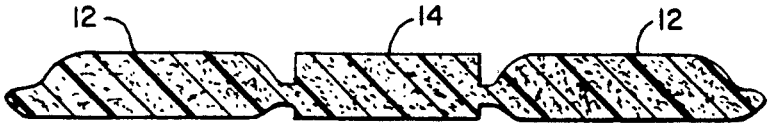
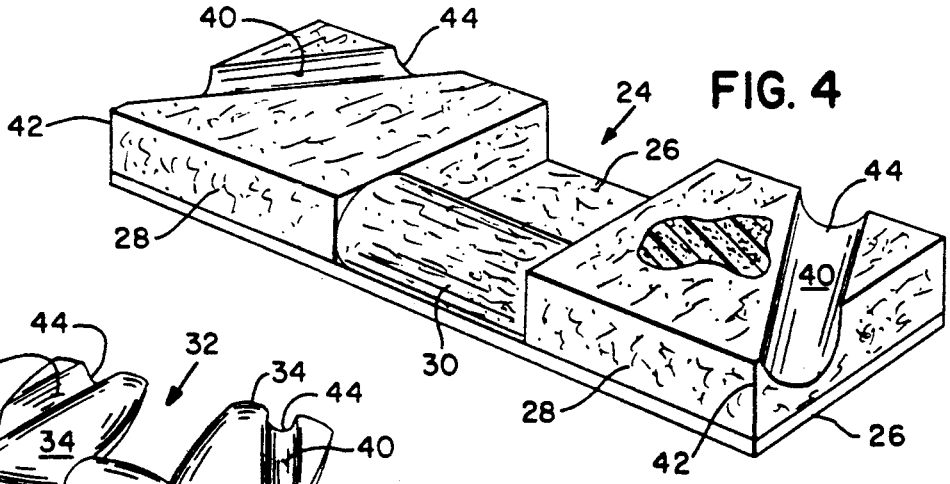
FIG. 4
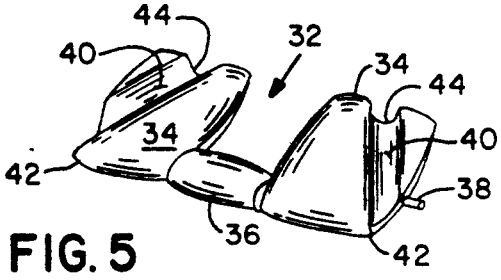
FIG. 5

MULTIPLE POSTURE SLEEPING PILLOW WITH ARM REST

BACKGROUND OF THE INVENTION

The instant invention relates generally to pillows for sleeping, and more particularly, to a multiple posture sleeping pillow with arm rest.

Numerous pillows have been provided in the prior art that are adapted to be used by persons with various neck conditions, or sleeping problems. For example, U.S. Pat. Nos. 4,754,513 to Rinz; 4,660,239 to Thomas; 4,513,462 to Thomas; 4,494,261 to Morrow; 4,218,792 to Kogan; 3,849,810 to Degen; 3,667,074 to Emery; 2,952,856 to Ruff; 2,765,480 to Mueller; 2,396,227 to Reed; and 1,385,355 of Banks, all are illustrative of such prior art. While these units may be suitable for the particular purpose to which they address, they would not be as suitable for the purpose of the present invention as hereafter described.

SUMMARY OF THE INVENTION

A primary object of the present invention is to provide a multiple posture sleeping pillow that will overcome the shortcomings of the prior art devices.

Another object is to provide a multiple posture sleeping pillow that will be so designed, as to be a therapeutic device to be used by persons having neck conditions, such as whip lash, a herniated cervical disc, etcetera, or sleeping problems, which has a provision for also comfortably resting the arms.

An additional object is to provide a multiple posture sleeping pillow that will be so designed, as to be used as a form of therapeutic neck support device which will restore lorditic curve to the neck, increase curvature to the cervical region, reduce neck tension and stiffness, as well as some headache conditions.

A further object is to provide a multiple posture sleeping pillow that is simple and easy to use.

A still further object is to provide a multiple posture sleeping pillow that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a perspective view of the instant invention showing an optional connecting web in dash line and a patient in phantom;

FIG. 2 is a cross sectional view taken along the line 2—2 of FIG. 1;

FIG. 3 is a cross sectional view taken along the line 3—3 of FIG. 1;

FIG. 4 is a perspective view of a second embodiment of the invention with parts broken away;

FIG. 5 is a diagrammatic perspective view of an inflatable third embodiment of the invention.

DETAILED DESCRIPTION OF THE PREFERRED EMBODIMENTS

Figure 6:
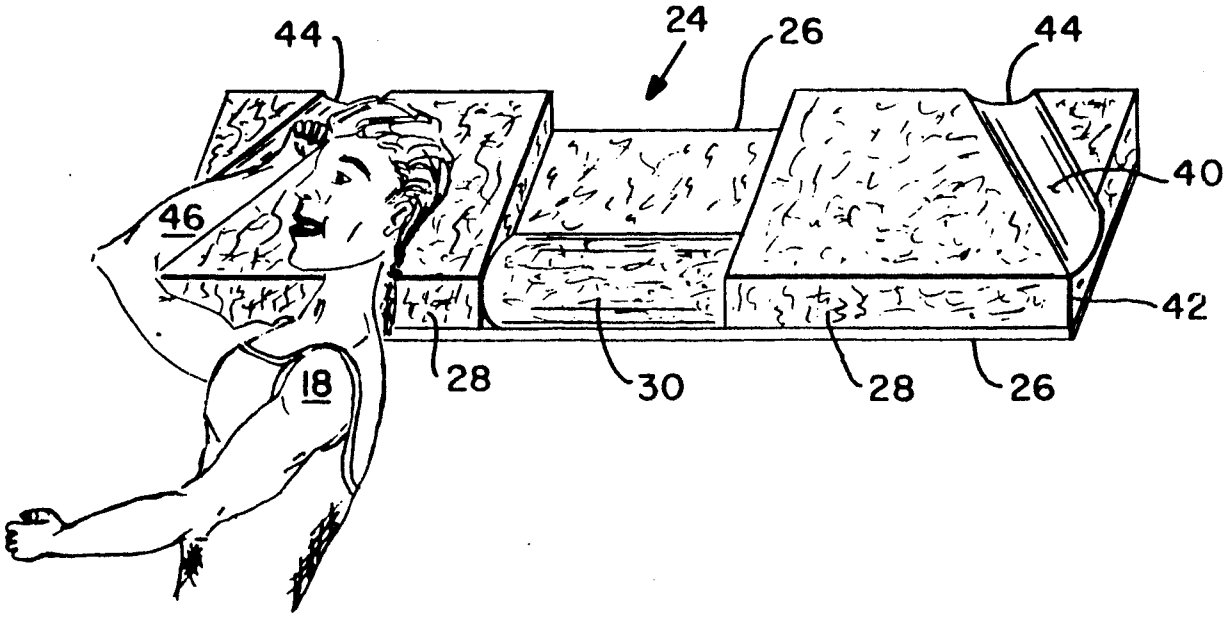
FIG. 6 is a reduced perspective view of a second embodiment illustrating another position which a person may also find quite beneficial.

Turning now descriptively to the drawings, in which like reference characters denote like elements throughout the several views, in FIG. 1, the instant invention 10 is shown to include a pair of rectangular spaced apart chamferd foam rubber cushions 12 having a foam rubber intermediate cylindrical neck support member 14 fixedly secured to edges thereof. The outer edges of members 12 are somewhat rounded. The outer peripheral surface of intermediate cylindrical neck support member 14 is designed to engage with the back of the neck 16 of a user 18, while the head of the user is disposed in the space between members 12.

As best seen in FIGS. 1, 3 and 6, an optional connecting web 20 may also be secured to and between members 12 and provides for resting of the back of the head of the user 18 while simultaneously preventing the cushions 12 from spreading apart. A grooved furrow 40 is provided in each cushion 12 which runs from an outer corner 42 to a location 44 approximately in the middle of the rear edge thereof, so that a user 18 resting on the instant invention 10 has a comfortable place to rest his/her arm or arms 46.

In use, instant invention 10 is placed upon a bed covering 22 and the user 18 places his neck 16 on the cylindrical intermediate member 14, which supports the neck and elevates the head somewhat, of the user 18, the user may optionally place either or both arms 46, in the furrows 40 it he/she so desires.

Referring now to FIG. 4 and of the drawings, a second embodiment 24 is shown to include a rectangular base 26 and a pair of spaced apart cushions 28, which are fixedly secured to a surface of base 26. Base 26, as well as cushions 28, are fabricated of a semi-rigid foam material with an intermediate cylindrical member 30 of oval cross-sectional configuration, which is fixedly secured to and between cushions 28 for the neck of a user (not shown in this figure). Similarly in this embodiment 24 a grooved furrow 40 is provided in each cushion 28 which runs from an outer corner 42 to a location 44 approximately in the middle of the rear edge thereof, so that a user 18 resting on the instant invention has a comfortable place to rest his/her arm or arms 46.

In use, the second embodiment 24 functions in a similar manner as the embodiment described in FIG. 1 the only exception being that cushions 28 have square edges and the base 26 extends completely across the bottom of the structure, and the structure is intended to be fabricated out of a relatively rigid material.

Looking now at FIG. 5 of a drawing of a third embodiment 32 is shown to be inflatable and includes a pair of spaced apart cushions 34 that are fabricated out of a suitable rubber or plastic material that will be inflatable. An intermediate cylindrical member 36 is provided and is also inflatable, and is fixedly secured at its ends to end portions of cushions 34.

An air valve 38 is also secured fixedly to one side of one of the cushions 34 for the inflation of embodiment 32.

In use, embodiment 32 is first inflated by the employment of the air valve 38. When inflation is completed, embodiment 32 is also used in a similar manner as the embodiment described in FIG. 1, the only exception being that embodiment 32 after use, may be deflated and folded compactly for storage . Also similarly in this embodiment 32 a grooved furrow 40 is provided in each cushion 34 which runs from an outer corner 42 to a location 44 approximately in the middle of the rear edge thereof, so that a user 18 resting on the instant invention has a comfortable place to rest his/her arm or arms 46.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A multiple posture sleeping pillow comprising a pair of rectangular cushions having front and rear edge and a pair of side edges located adjacent in parallel spaced apart relation and an intermediate cylindrical neck supporting member having opposite axial ends attached to respective edges of the pair of adjacent side edges adjacent respective front edges providing a head receiving well located rearwardly of said neck supporting member and between said pair of side edges, a grooved furrow arm rest in each cushion, extending at an angle rearwardly away from the neck supporting member for locating the forearms of a user extending rearwardly of the neck.

2. A multiple posture sleeping pillow, as recited in claim 1 wherein, a web member is also attached between said pair of spaced apart cushions, and provides a bottom head resting wall of said well, said web member being also attached to adjacent edges of respective cushions.

3. A multiple posture sleeping pillow, as recited in claim 2 wherein, said cushions of said pair of rectangular spaced apart cushions, have chamfered edges.

4. A multiple posture sleeping pillow, as recited in claim 3 wherein, said intermediate cylindrical neck support member and said pair of rectangular spaced apart cushions, are fabricated out of foam rubber.

5. A multiple posture sleeping pillow, as recited in claim 2 wherein, said pair of rectangular spaced apart cushions, have square edges and a base member incorporating said web extends completely under said cushions.

6. A multiple posture sleeping pillow, as recited in claim 5 wherein, said intermediate cylindrical neck support member and said pair of rectangular spaced apart cushions, are fabricated out of rigid foam material.

7. A multiple posture sleeping pillow, as recited in claim 3 wherein, said intermediate cylindrical neck support member and said pair of rectangular spaced apart cushions, are inflatable.

8. A multiple posture sleeping pillow as recited in claim 1 wherein the grooved furrows incline towards each other as they extend rearwardly.

9. A multiple posture sleeping pillow as set forth in claim 1 in which the grooved furrows open at remote side edges of respective cushion.

* * * * *